US007012527B2

(12) United States Patent
Sunakawa et al.

(10) Patent No.: US 7,012,527 B2
(45) Date of Patent: Mar. 14, 2006

(54) RESONATOR FOR USE IN ELECTRONIC ARTICLE SURVEILLANCE SYSTEMS

(75) Inventors: Jun Sunakawa, Tottori-ken (JP); Daichi Azuma, Tottori-ken (JP); Yoshio Bizen, Meerbusch (DE)

(73) Assignee: Hitachi Metals, Ltd., Tokyo (JP)

( * ) Notice: Subject to any disclaimer, the term of this patent is extended or adjusted under 35 U.S.C. 154(b) by 98 days.

(21) Appl. No.: 10/642,572

(22) Filed: Aug. 19, 2003

(65) Prior Publication Data

US 2004/0036607 A1 Feb. 26, 2004

(30) Foreign Application Priority Data

Aug. 20, 2002 (JP) ..... 2002-239651

(51) Int. Cl.
*G08B 13/14* (2006.01)

(52) U.S. Cl. ..... 340/572.1; 148/304

(58) Field of Classification Search ..... 340/572.1, 340/572.6, 568.1; 148/304, 108
See application file for complete search history.

(56) References Cited

U.S. PATENT DOCUMENTS

| | | | | |
|---|---|---|---|---|
| 4,865,664 | A * | 9/1989 | Sato et al. | 148/403 |
| 4,958,134 | A * | 9/1990 | Sawa et al. | 333/12 |
| 5,804,282 | A * | 9/1998 | Watanabe et al. | 428/141 |
| 6,011,475 | A | 1/2000 | Herzer | |
| 6,137,412 | A * | 10/2000 | Herzer | 340/572.6 |
| 6,299,702 | B1 | 10/2001 | Herzer | |
| 6,359,563 | B1 * | 3/2002 | Herzer | 340/572.6 |
| 6,749,700 | B1 * | 6/2004 | Sunakawa et al. | 148/561 |

FOREIGN PATENT DOCUMENTS

WO WO 90/03652 4/1990

* cited by examiner

*Primary Examiner*—Jeffery Hofsass
*Assistant Examiner*—Jennifer Stone
(74) *Attorney, Agent, or Firm*—Sughrue Mion, PLLC

(57) ABSTRACT

A resonator for use in a marker in an electronic article surveillance system having an amorphous alloy ribbon having a width of 7 mm or less and a thickness of 18 μm to 23 μm. The amorphous alloy ribbon preferably has an average surface roughness Ra of 0.45 μm or less.

2 Claims, 4 Drawing Sheets

RESONATOR FOR USE IN ELECTRONIC ARTICLE SURVEILLANCE SYSTEMS

FIELD OF THE INVENTION

The present invention relates to a resonator for use in a marker in an electronic article surveillance system constituted by an amorphous alloy ribbon for use in article surveillance systems, etc. utilizing magnetostriction vibration.

BACKGROUND OF THE INVENTION

One of article surveillance systems utilized for the prevention of shoplifting in supermarkets, etc. is an article surveillance system using magnetostrictive materials. The article surveillance system of this type is proposed, for instance, by U.S. Pat. No. 4,510,489. This article surveillance system comprises a marker secured to an article, etc., and a gate for detecting the marker passing therethrough by a receiver comprising one transmitter and two receiving circuits.

The marker is composed of a resonator having soft magnetic properties, and a bias material having semi-hard magnetic properties and placed adjacent to the resonator. Generally, amorphous alloys are used for the resonator, while crystalline materials are used for the bias material. When the bias material adjacent to the resonator is magnetized, the resonator is activated, whereby the marker is activated. On the other hand, when the bias material is demagnetized, the resonator is deactivated, whereby the marker is deactivated. A gate disposed at an exit detects an activated resonator, so that only merchandise that has not been properly accounted for can be detected.

A transmitter and a receiver are placed in the gate at adjacent positions, and the transmitter repeatedly emits a weak AC magnetic field of a particular radio frequency at a certain interval. The receiver is set to operate while the transmitter does not emit the AC magnetic field.

The active resonator resonates when receiving the above AC magnetic field of a particular frequency from the transmitter, thereby emitting a signal. When the transmitter stops generating the AC magnetic field, a signal emitted from this resonator by its resonance is attenuated exponentially. This exponential attenuation characteristic is determined by materials used for the resonator.

Two receiving circuits in the gate detect a signal emitted from the resonator during the idle period of the transmitter with a time lag. This time lag is determined by the distance between the two receiving circuits and the moving speed of the marker. The attenuation characteristics of the signal are determined from the intensity and time lag of these two signals in the gate. When the attenuation characteristics of a particular signal are identical with those measured in advance on the resonator, alarm is generated. Because the signal to be detected can be differentiated from those generated by other articles than the resonator (signals having different attenuation characteristics), this system can advantageously avoid malfunction at the gate.

Required as basic characteristics for the resonator used in the above marker are that a large signal output is generated from the transmitter in an active state by an AC magnetic field, and that the signal has a small attenuation speed.

Used in resonators requiring these magnetic properties are amorphous alloys as described above. The amorphous alloy is usually produced by a liquid-quenching method such as a single roll method in a ribbon form, which is cut to a required shape. In most cases, an amorphous alloy ribbon produced by the liquid-quenching method is heat-treated in a magnetic field to improve magnetic properties and then used for a resonator.

As a method for improving properties necessary for the resonator for use in a marker in an electronic article surveillance system, that is, the intensity and attenuation time of a signal output generated by an AC magnetic field, for instance, U.S. Pat. No. 6,011,475 discloses a heat treatment of an amorphous alloy ribbon in a magnetic field having a predetermined angle to a surface of the amorphous alloy ribbon.

Though the above heat treatment in an angled magnetic field increases an output signal of a resonator, it is increasingly required that the resonator has higher output characteristics, because the output characteristics of the resonator directly affect the sensitivity of an article surveillance system comprising the resonator.

OBJECT OF THE INVENTION

Accordingly, an object of the present invention is to provide a resonator for use in a marker in an electronic article surveillance system constituted by an amorphous alloy ribbon having improved output characteristics.

SUMMARY OF THE INVENTION

As a result of intense research in view of the above object, the inventors have found that a resonator for use in a marker in an electronic article surveillance system having a proper thickness makes it possible to increase output signals while reducing the unevenness of the output signals. The present invention has been completed based on this finding.

Thus, the resonator of the present invention is comprises an amorphous alloy ribbon having a width of 7 mm or less and a thickness of 18 $\mu$m to 23 $\mu$m. To fully exhibit the effect of the present invention, the resonator preferably has an average surface roughness Ra of 0.45 $\mu$m or less.

DETAILED DESCRIPTION OF THE PREFERRED EMBODIMENTS

Figure 1:
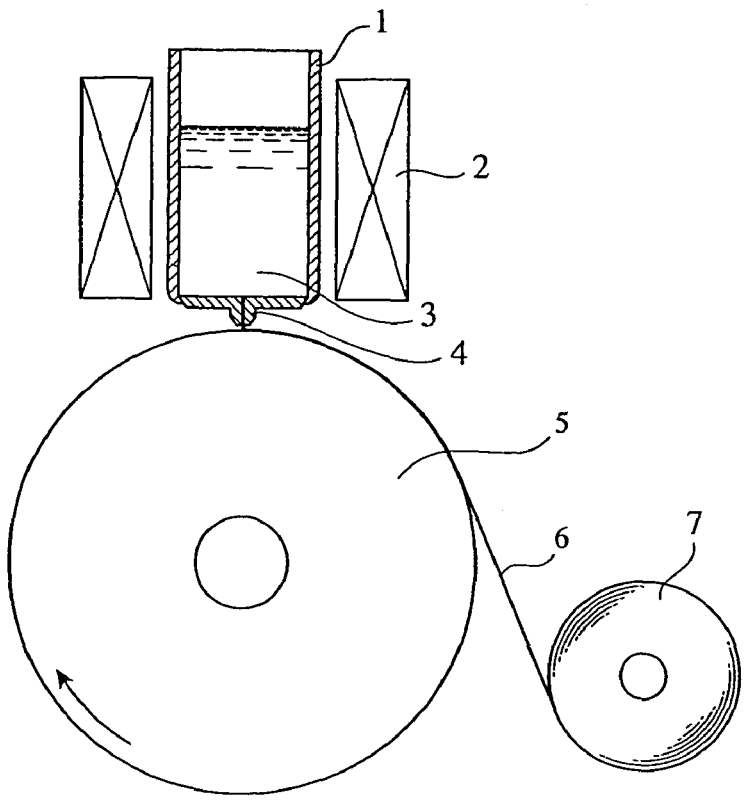
FIG. 1 is a schematic cross-sectional view showing one example of casting apparatuses for producing an amorphous alloy ribbon used in the present invention.

The present invention provides a resonator for use in a marker in an electronic article surveillance system with an increased output signal by a different means from those conventional. In the conventional technologies, an output signal from a resonator during the operation of a transmitter is increased by reducing eddy current losses with reduced magnetic domain width. In the present invention, on the other hand, an output signal from a resonator after stopping a transmitter is increased by optimizing the shape of an amorphous alloy ribbon. The present invention will be explained in detail below.

As described above, in an article surveillance system, etc., an output signal from a resonator is received by a receiver while a transmitter stops generating an AC magnetic field. It has conventionally been considered that a signal received by a receiver can be increased by enhancing an output signal from a resonator during the operation of a transmitter. The method for increasing the output signal of the resonator during the operation of the transmitter is described in U.S. Pat. No. 6,011,475.

In addition to the technology described in U.S. Pat. No. 6,011,475, an effective way for increasing an output signal from a resonator for use in a marker in an electronic article surveillance system during the operation of a transmitter has been considered to increase the thickness of an amorphous alloy ribbon to such an extent that a crystal phase is not remarkably generated in the ribbon by reducing the cooling speed of the ribbon during its casting. This is based on the confirmed theory that the more the cross-sectional area of a resonator (amorphous alloy) in a width direction thereof, the larger its output signal. Resonators as small as 7 nm or less in width are recently used to reduce the size of article surveillance systems, and such narrow resonators use thick amorphous alloy ribbons to have large cross-sectional areas. As a result, amorphous alloy ribbons having a thickness of 25 μm or more are widely used in presently available resonators as narrow as 7 mm or less.

On the contrary, the present invention is based on the finding that excellent output characteristics can be obtained by using an amorphous alloy ribbon having a thickness of 18 μm to 23 μm, thinner than the conventional ribbon, in a resonator having a width of 7 mm or less. Because the amorphous alloy ribbon used in the resonator of the present invention having a width of 7 mm or less is as thin as 18 to 23 μm, an output signal emitted from the resonator during the operation of a transmitter is smaller than those from the conventional resonators. With respect to the level of an output signal emitted from the resonator after the stop of a transmitter, however, the resonator comprising an amorphous alloy ribbon having a thickness of 18 μm to 23 μm is higher than the conventional resonators comprising amorphous alloy ribbons thicker than 23 μm. Actually received from a resonator used in a marker in an electronic article surveillance system, etc., is an output signal emitted after the stop of a transmitter. Accordingly, the resonator of the present invention practically provides higher output signals.

Experiments by the inventors have proved that the resonator of the present invention provides an increased output signal with reduced unevenness.

Experiments by the inventors have proved that the resonator for use in a marker in an electronic article surveillance system of the present invention provides an increased output signal with reduced unevenness.

Though it is not clear why the resonator of the present invention provides a larger output signal after the stop of a transmitter than the conventional resonators having larger ribbon thickness (cross section), it is presumed that the reduction of the ribbon thickness decreases the rigidity of the resonator, and a friction between the periphery of the resonator and an inner wall of a casing containing the resonator, which would be higher if the ribbon were thick and thus the resonator were heavy, thereby lowering the attenuation of the once generated magnetostriction vibration. An additional factor for improving an output signal appears to be the reduction of eddy current loss by decrease in a ribbon thickness. These effects are obtained by an amorphous alloy ribbon having a thickness of 23 μm or less in a resonator having a width of 7 mm or less.

It is difficult to cast an amorphous alloy ribbon thinner than 18 μm. Even if it is cast, the resultant amorphous alloy ribbon is likely to have large surface roughness. When the amorphous alloy ribbon has large surface roughness, only a small output signal is obtained for reasons mentioned below. In addition, because the ribbon has too small cross-sectional area, too small an output signal is provided from the resonator during the operation of a transmitter, though once generated magnetostriction vibration is hardly attenuated. As a result, sufficient output is unlikely to be obtained even after the transmitter stops. Accordingly, the amorphous alloy ribbon should have a thickness of 18 μm or more.

Thus, the resonator of the present invention has a width of 7 mm or less and a thickness of 18 μm to 23 μm. It preferably has a width of 4 mm to 7 mm and a thickness of 19 μm to 22 μm. The lower limit in the preferable range of the width is to provide the amorphous alloy ribbon with a sufficient cross-sectional area.

The thickness T of the resonator of the present invention is determined from the length L, weight M, density p and width W of the amorphous alloy ribbon, by the formula:

$$T=M/(\rho\times L\times W).$$

The amorphous alloy ribbon preferably has an average surface roughness Ra of 0.45 μm or less. When the amorphous alloy ribbon is used as a resonator for use in a marker in an electronic article surveillance system, a heat treatment is carried out in a magnetic field as proposed by U.S. Pat. No. 6,011,475. With respect to the heat treatment in a magnetic field, various methods utilizing different directions of magnetic fields are proposed. All of such methods are used to provide amorphous alloy ribbons with magnetic anisotropy.

The inventors have found that when an amorphous alloy ribbon having an average surface roughness Ra of 0.45 μm or less is heat-treated in a magnetic field, the remarkable effects of a heat treatment are obtained.

The provision of magnetic anisotropy by a heat treatment in a magnetic field is accompanied by the movement of magnetic domain walls, but the surface roughness of the amorphous alloy ribbon hinders the movement of the magnetic domain walls. With the surface roughness Ra of 0.45 μm or less, the movement of magnetic domain walls is easy near the surface of the amorphous alloy ribbon, making it possible to surely provide the amorphous alloy ribbon with magnetic anisotropy.

The influence of the surface roughness of the amorphous alloy ribbon is more remarkable when the amorphous alloy ribbon is thinner. Because conventional thick amorphous alloy ribbons provide strong signals due to large cross sections, the surface roughness is less influential. On the contrary, in the present invention using an amorphous alloy ribbon as thin as 23 μm or less, the control of the surface roughness of the amorphous alloy ribbon is particularly important. The average surface roughness Ra of the amorphous alloy ribbon is preferably 0.4 μm or less.

The surface roughness Ra is obtained by measuring the roughness of the amorphous alloy ribbon on a surface in contact with a cooling roll in the casting process, according to JIS B 0601.

Liquid-quenching methods are widely known as methods for producing an amorphous alloy ribbon. The liquid-quenching methods include a single roll method, a double roll method, a centrifugal method, etc., and preferable among them from the aspect of productivity and the maintenance of an apparatus is a single roll method in which a molten metal is supplied onto a cooling roll rotating at a high speed and rapidly quenched to form an alloy ribbon. FIG. 1 is a schematic view showing an apparatus for carrying out the single roll method. In the apparatus shown in FIG. 1, an ingot having a predetermined composition fed into a crucible 1 is melted by a high-frequency coil 2, and the resultant alloy melt 3 is ejected through a nozzle 4 onto a cooling roll 5 and rapidly quenched to form an amorphous alloy ribbon 6, which is continuously wound around a winding roll 7.

In the case of the single roll method, the following methods (1) to (4) may be used to produce a thin amorphous alloy ribbon.

(1) Increasing the peripheral speed of the cooling roll.
(2) Narrowing a gap, which is a distance between a tip end of a melt-ejecting nozzle and a cooling roll surface.
(3) Reducing the size of a nozzle slit.
(4) Lowering the melt-ejecting pressure.

The inventors' investigation has revealed, however, that other conditions than the above conditions are required to produce an amorphous alloy ribbon having a thickness of 23 μm or less and small surface roughness. It is preferable that the peripheral speed of the cooling roll is lowered, and that the melt-ejecting pressure is elevated. If the gap is too narrow, a paddle (a melt pool formed between the melt-ejecting nozzle and the cooling roll surface) easily comes into contact with the tip end of the nozzle, likely resulting in large surface roughness.

Specifically, the preferred production conditions are such that the peripheral speed of the cooling roll is 30 m/second or less, the distance between the tip end of the nozzle and the cooling roll surface is 100 μm to 200 μm, and the melt-ejecting pressure is 22 kPa to 34 kPa.

EXAMPLE 1

Figure 2:
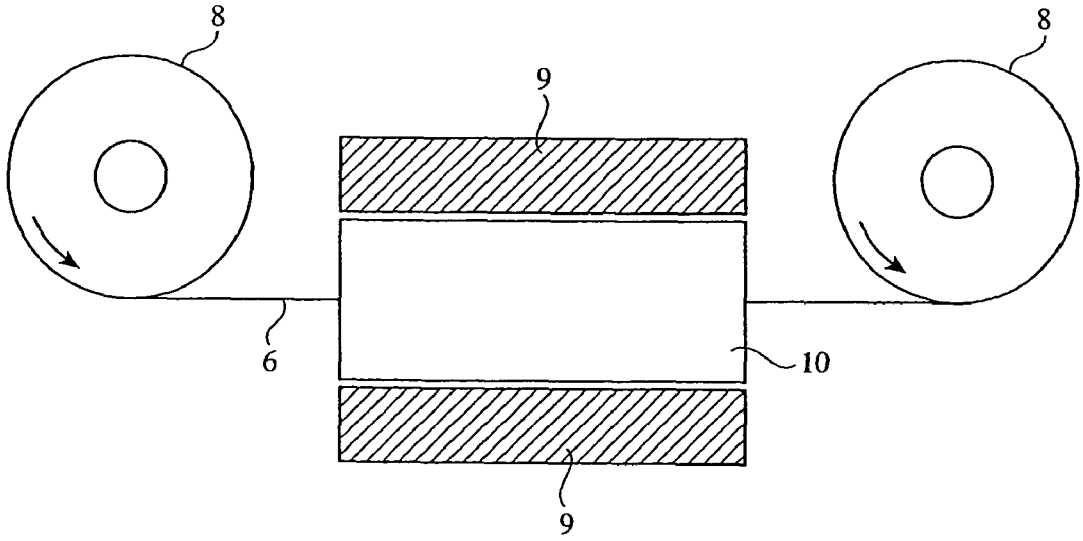
FIG. 2 is a schematic cross-sectional view showing one example of apparatuses for heat-treating an amorphous alloy ribbon used in the present invention.

50 kg of an amorphous alloy ribbon having a composition of 24 atomic % of Fe, 12 atomic % of Co, 2 atomic % of Si and 16 atomic % of B, the balance being substantially Ni, and having a width of 35 mm, a thickness of about 21 μm to 22 μm was produced by an apparatus shown in FIG. 1. This amorphous alloy ribbon was cut to 6 mm in width and wound by a reel. It was then heat-treated by a heat treatment apparatus shown in FIG. 2. In the heat treatment apparatus shown in FIG. 2, the amorphous alloy ribbon 6 was taken from a reel 8 on the left side, introduced into a heat treatment furnace 10 equipped with magnets 9 to carry out heat treatment in a magnetic field continuously, and wound around a reel 8 on the right side.

The main production conditions of the amorphous alloy ribbon and the heat treatment conditions after cutting the ribbon to 6 mm in width were as follows:

Production conditions of amorphous alloy ribbon

Peripheral speed of cooling roll: 25 m/second,

Distance between nozzle tip end and cooling roll surface: 140 μm, and

Melt-ejecting pressure: 27 kPa.

Heat treatment conditions after cutting ribbon to 6 mm in width

Furnace temperature: 360° C.,

Intensity of magnetic field: 120 kA/m,

Angle of ribbon surface to magnetic field: 83°, and

Heat treatment time: 6 second.

5 pairs of test pieces each having a length of 37 mm were cut out from the ribbon continuously heat-treated under the above conditions. A pair of test pieces were overlapped in a thickness direction and placed in a DC-bias magnetic field. A weak AC magnetic field having a magnetic field strength of 1.4 A/m and a frequency of 50 kHz to 65 kHz was added. Incidentally, any magnetic field was applied to the above ribbons along their longitudinal direction.

In each DC-bias magnetic field whose intensity was increased from 80 A/m to 800 A/m with an increment of 40 A/m, the change of an output signal with time was measured after shutting the above AC magnetic field.

Further, 120-mm-long test pieces were cut out at positions where the above five pairs of test pieces were taken, to evaluate their DC magnetic properties (maximum permeability) before heat treatment.

The thickness of each ribbon was measured on a 0.5-m-long test piece cut out near a position where the above test piece was taken.

EXAMPLES 2 TO 9 AND COMPARATIVE EXAMPLES 1 TO 10

Each test piece of Examples 2 to 9 and Comparative Examples 1 to 10 was produced and evaluated in the same manner as in Example 1 except for changing the thickness of the amorphous alloy ribbon. The thickness of each amorphous alloy ribbon was adjusted by changing the slit size of the melt-ejecting nozzle.

Figure 3:
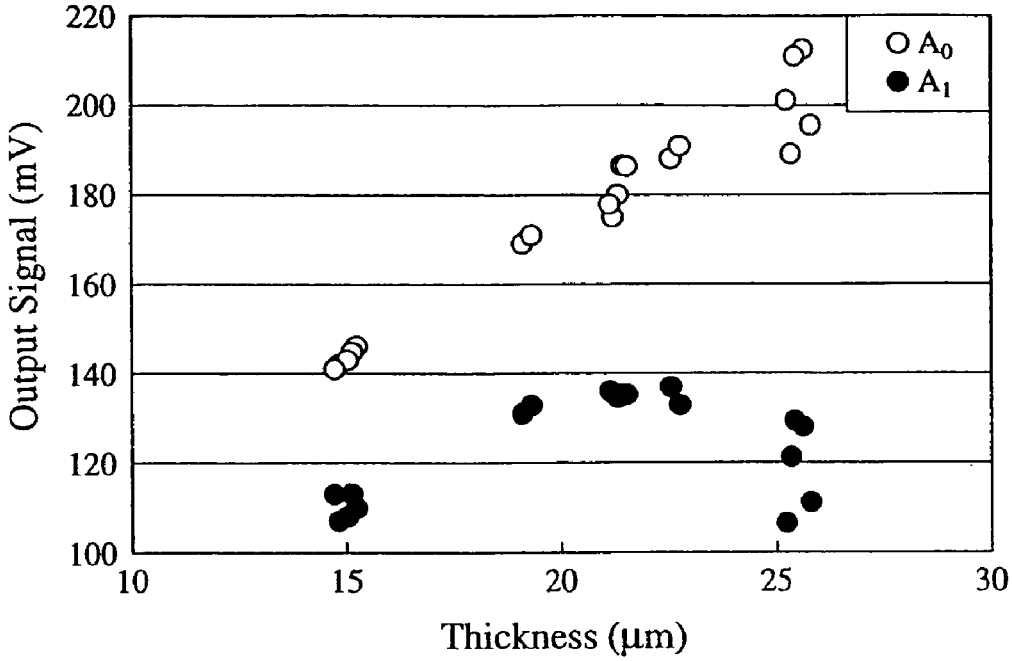
FIG. 3 is a graph showing the relations between the thickness of an amorphous alloy ribbon and output signals $A_0$. $A_1$ of a resonator for use in a marker in an electronic article surveillance system.
Figure 4:
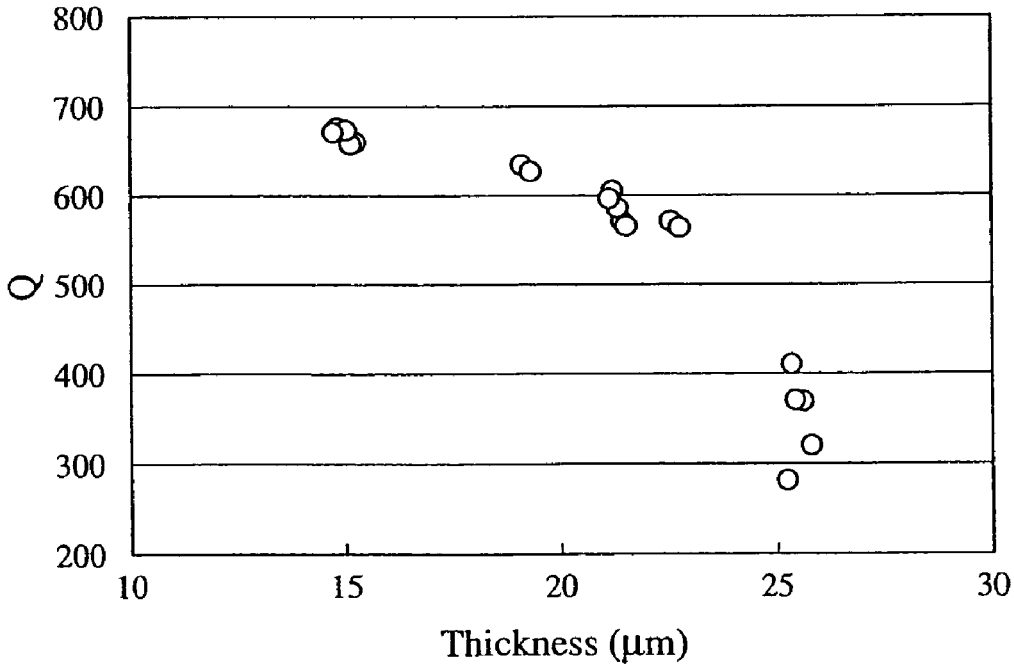
FIG. 4 is a graph showing the relations between the thickness of an amorphous alloy ribbon and Q.

The evaluation results of the amorphous alloy ribbons of Examples 1 to 9 and Comparative Examples 1 to 10 are shown in Table 1. The relations between the thickness of each amorphous alloy ribbon and output signals $A_0$ and $A_1$ are shown in FIG. 3, and the relations between the thickness of each amorphous alloy ribbon and Q are shown in FIG. 4. $\mu_m$ represents the maximum permeability before the heat treatment, $A_0$ represents an output signal at a bias magnetic field strength of 520 A/m before shutting the AC magnetic field, and $A_1$ represents an output-signal at the same bias magnetic field strength as $A_0$ after 1 ms passed from shutting the AC magnetic field. Q was calculated by the equation of $Q=\pi fr/\ln(A_0/A_1)$, wherein fr represents a resonant frequency of the bias magnetic field when $A_0$ and $A_1$ were measured. The bigger the value of Q, the less the attenuation of a signal occurs.

TABLE 1

| | Thickness | Before Heat Treatment | After Heat Treatment | | |
|---|---|---|---|---|---|
| No. | (μm) | $\mu_m$ | $A_0$ (mV) | $A_1$ (mV) | Q |
| Example 1 | 21.2 | 58,200 | 175 | 135 | 606 |
| Example 2 | 21.4 | 21,900 | 186 | 135 | 570 |
| Example 3 | 21.5 | 24,700 | 186 | 135 | 566 |
| Example 4 | 21.3 | 70,900 | 180 | 134 | 585 |
| Example 5 | 21.1 | 38,100 | 178 | 136 | 597 |
| Example 6 | 19.1 | 66,800 | 169 | 131 | 635 |
| Example 7 | 19.3 | 38,600 | 171 | 133 | 627 |
| Example 8 | 22.5 | 67,500 | 188 | 137 | 571 |
| Example 9 | 22.7 | 41,000 | 191 | 133 | 564 |

TABLE 1-continued

| No. | Thickness (μm) | Before Heat Treatment $\mu_m$ | After Heat Treatment $A_0$ (mV) | $A_1$ (mV) | Q |
|---|---|---|---|---|---|
| Comparative Example 1 | 25.2 | 28,900 | 201 | 106 | 283 |
| Comparative Example 2 | 25.8 | 13,900 | 196 | 111 | 321 |
| Comparative Example 3 | 25.6 | 75,100 | 212 | 128 | 370 |
| Comparative Example 4 | 25.3 | 53,900 | 189 | 121 | 411 |
| Comparative Example 5 | 25.4 | 74,900 | 211 | 129 | 371 |
| Comparative Example 6 | 15.2 | 59,500 | 146 | 110 | 660 |
| Comparative Example 7 | 14.8 | 31,500 | 142 | 107 | 675 |
| Comparative Example 8 | 15.1 | 19,800 | 145 | 113 | 658 |
| Comparative Example 9 | 15.0 | 28,700 | 143 | 108 | 672 |
| Comparative Example 10 | 14.7 | 43,100 | 141 | 113 | 670 |

As is clear from FIG. 3, as the thickness of the amorphous alloy ribbon increased, the output signal $A_0$ before shutting the AC magnetic field increased. The output signal $A_1$ after 1 ms passed from shutting the AC magnetic field was maximum in the test pieces of Examples 1 to 5 having a thickness of 21 μm to 22 μm. It is presumed as shown in FIG. 4 that the signal is less attenuated by the thinner resonator. In the test pieces of Comparative Examples 1 to 5, $A_1$ was largely uneven by $\mu_m$ before the heat treatment. On the other hand, in the test pieces of Examples 1 to 5, $A_1$ was less uneven by $\mu_m$, proving that the amorphous alloy ribbon of the present invention is less affected by the magnetic properties before the heat treatment.

The test pieces of Comparative Examples 6 to 10 as thin as 14 μm to 15 μm had $A_1$ hardly affected by $\mu_m$ before the heat treatment, with large Q. However, because $A_0$ per se was small, $A_1$ was also small.

EXAMPLES 10 TO 19

Each amorphous alloy ribbon of Examples 10 to 19 was produced in the same manner as in Example 1 except for changing the production conditions. The heat treatment conditions by the apparatus shown in FIG. 2 after cutting the ribbon to 6 mm in width were the same as in Example 1.

Production conditions of amorphous alloy ribbon

Peripheral speed of cooling roll: 25 m/second,

Distance between nozzle tip end and cooling roll surface: 120 μm, and

Melt-ejecting pressure: 30 kPa.

Each test piece of Examples 10 to 19 was measured with respect to $A_0$, $A_1$, DC magnetic properties (maximum permeability) before the heat treatment, and thickness, in the same manner as in Example 1. The roughness of the amorphous alloy ribbon was measured according to JIS B 0601 on a surface in contact with the cooling roll in the casting process.

Further, amorphous alloy ribbons having the same thickness and different surface roughness were produced by changing the peripheral speed of the cooling roll to 32 m/s, and the distance between the tip end of the nozzle and the cooling roll surface to 180 μm, and by adjusting the slit size of the melt-ejecting nozzle and the melt-ejection pressure. Each of the resultant amorphous alloy ribbons was then heat-treated and evaluated under the same conditions as above.

The evaluation results are shown in Table 2. The relations between the surface roughness of each amorphous alloy ribbon and output signals $A_0$ and $A_1$ are shown in FIG. 5, and the relations between the surface roughness of each amorphous alloy ribbon and Q are shown in FIG. 6.

TABLE 2

| No. | Thickness (μm) | Surface Roughness Ra (μm) | After Heat Treatment $A_0$ (mV) | $A_1$ (mV) | Q |
|---|---|---|---|---|---|
| Example 10 | 20.5 | 0.31 | 181 | 137 | 621 |
| Example 11 | 20.8 | 0.28 | 188 | 136 | 572 |
| Example 12 | 21.2 | 0.32 | 190 | 139 | 566 |
| Example 13 | 21.8 | 0.33 | 194 | 138 | 585 |
| Example 14 | 21.5 | 0.29 | 192 | 140 | 592 |
| Example 15 | 21.2 | 0.64 | 173 | 127 | 583 |
| Example 16 | 20.4 | 0.63 | 170 | 129 | 590 |
| Example 17 | 21.8 | 0.68 | 168 | 120 | 572 |
| Example 18 | 21.4 | 0.66 | 171 | 128 | 595 |
| Example 19 | 21.6 | 0.65 | 172 | 128 | 591 |

Figure 5:
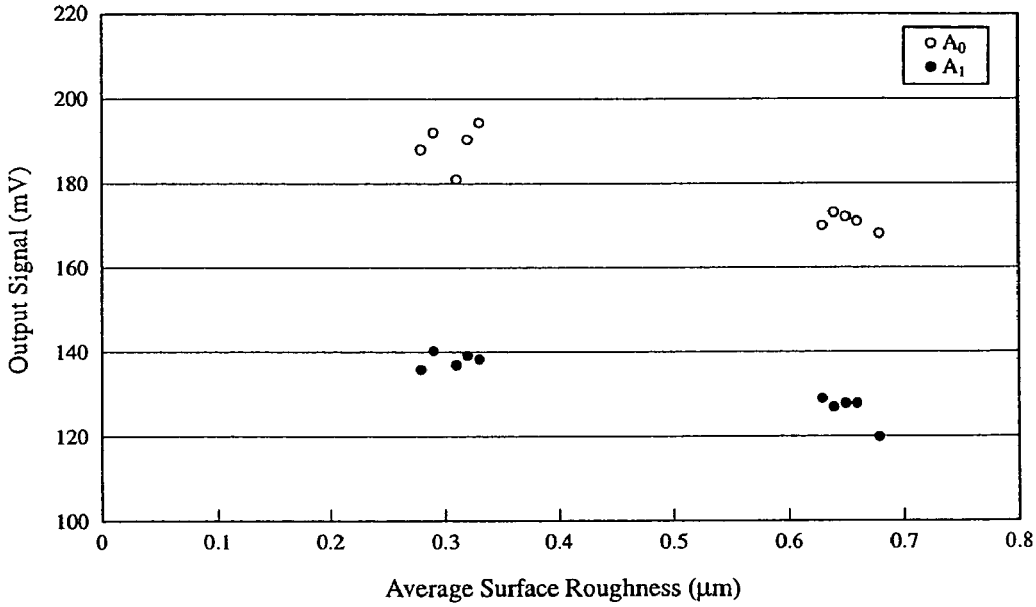
FIG. 5 is a graph showing the relations between the surface roughness of an amorphous alloy ribbon and output signals $A_0$, $A_1$ of a resonator for use in a marker in an electronic article surveillance system.
Figure 6:
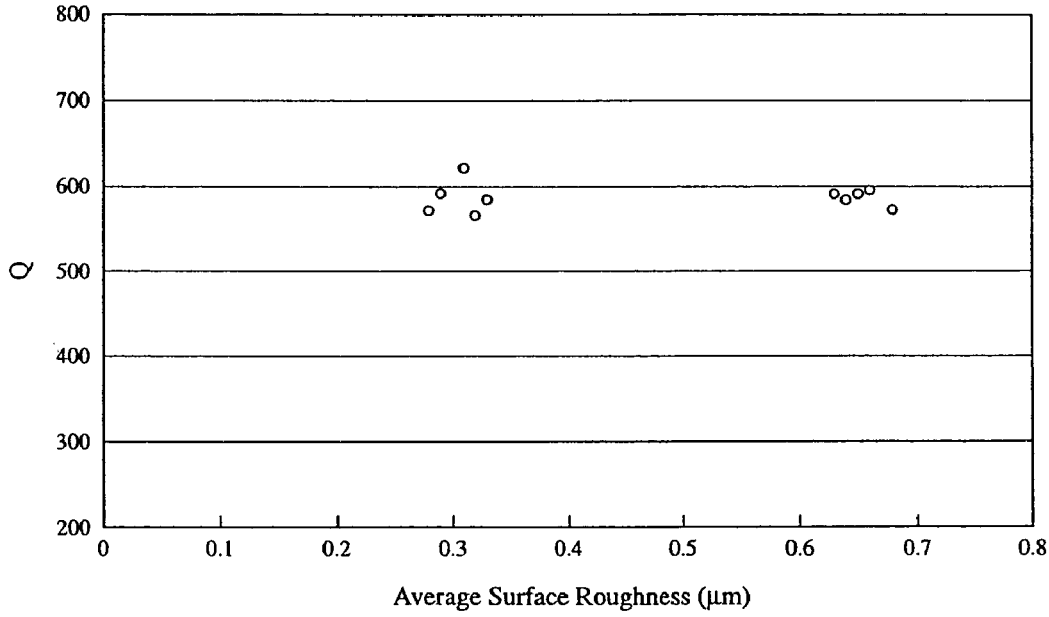
FIG. 6 is a graph showing the relations between the surface roughness of an amorphous alloy ribbon and Q.

As shown in FIG. 5, both $A_0$ and $A_1$ of the test pieces of Examples 10 to 14 having surface roughness in the preferable range of the present invention were larger than those of Examples 15 to 19, proving that an output signal can be increased by reducing the surface roughness. As shown in FIG. 6, the value of Q representing the difficulty of the attenuation of an output signal is substantially on the same level even with different surface roughness.

The resonator for use in a marker in an electronic article surveillance system of the present invention using an amorphous alloy ribbon having a proper thickness can provide a higher output signal.

What is claimed is:

1. A resonator for use in a marker in an electronic article surveillance system, said resonator comprising an amorphous alloy ribbon having a width of 7 mm or less and a thickness of 18 μm to 23 μm, wherein said amorphous alloy ribbon has an average surface roughness Ra of 0.45 μm or less.

2. The resonator according to claim 1, wherein said amorphous alloy ribbon has a width of 6 mm to 7 mm and a thickness of 19.1 μm to 22.7 μm.

* * * * *